US005468062A

United States Patent [19]

Finnegan

[11] Patent Number: 5,468,062

[45] Date of Patent: Nov. 21, 1995

[54] DOUBLE TIERED STORAGE TRAYS FOR A DRAWER

[76] Inventor: Richard J. H. Finnegan, 706 Athol Street, Whitby, Ontario, Canada

[21] Appl. No.: 102,183

[22] Filed: Aug. 4, 1993

[51] Int. Cl.[6] ..... A47B 88/22

[52] U.S. Cl. ..... 312/301; 312/298

[58] Field of Search ..... 312/294, 301, 312/330.1, 334.1, 334.14, 348.3, 301, 334.1, 114.3; 211/11, 27, 49.1, 59.4, 60.1, 70.7, 126, 123, 151, 162, 194, 183, 184

[56] References Cited

U.S. PATENT DOCUMENTS

| | | | |
|---|---|---|---|
| 128,439 | 6/1872 | Unna | 312/204 |
| 362,544 | 5/1887 | Scott | 312/270.2 |
| 2,471,529 | 5/1949 | Barre | 312/301 X |
| 3,490,823 | 12/1967 | Neu et al. | 312/330.1 X |
| 4,786,785 | 11/1988 | Feit | 312/308 X |
| 4,993,786 | 2/1991 | De Giullo | 312/301 X |
| 5,037,165 | 8/1991 | Rapp et al. | 312/330.1 |

FOREIGN PATENT DOCUMENTS

| | | | |
|---|---|---|---|
| 333857 | 12/1958 | Italy | 312/301 |

*Primary Examiner*—Kenneth J. Dorner
*Assistant Examiner*—Robert J. Sandy
*Attorney, Agent, or Firm*—Kenneth M. Garrett

[57] ABSTRACT

A two tiered drawer rack includes a base tray having a flange along each longitudinal side with, an upwardly facing track extending along each flange, and an upper tray with bearings which co-operate with the tracks to permit the upper tray to be moved between a forward position and a rearward position in which access is gained to the contents of the base tray. The tracks may be suitably molded into the flanges.

19 Claims, 4 Drawing Sheets

DOUBLE TIERED STORAGE TRAYS FOR A DRAWER

FIELD OF INVENTION

This invention relates to storage trays for drawers to increase the storage capacity thereof.

BACKGROUND OF INVENTION

In my U.S. Pat. No. 5,105,953, I describe a storage rack for use in cabinet drawers or the like, which comprises an upper tray and a base tray, each having a flange extending along each lateral side thereof. Support rails are provided with base jaws along the length thereof which grip the flanges of the base tray. The support rails have upper jaws which permit the flanges of the upper tray to slide therebetween, whereby the upper tray is moveable between a forward or closed position and a rearward or open position relative to the base tray. The flanges of the upper and base trays are trimmable along their length to permit the rack to fit drawers of various widths.

In U.S. Pat. No. 5,044,059 there is described a more complex two tiered storage rack for use with drawers wherein the base tray is provided with a roller track assembly disposed along upstanding longitudinal sides of the base tray. An upper tray is supported from the track assembly by cooperating track elements which are disposed along each longitudinal side of the upper tray.

It is often found desirable to remove the upper tray from the rack, either for the purpose of providing full access to the contents of the base tray, or to permit the upper tray to be used on a temporary basis independently of the rack. In my abovementioned patent the upper tray may only be removed following the removal of the drawer from the cabinet. While in the abovementioned -059 patent the upper tray may be simply lifted front the rack, this is made possible by the provision of an intermediate tray which tends to impede full access to the contents of the base tray, and which adds to the cost.

It is an object of my invention to provide a simple two tier tray system for drawers.

It is another object of my invention to provide a simple two tier tray system which permits the upper tray to be easily removed from the base tray so as to permit full access to the contents stored in the base tray and the use of the upper tray apart from the rack.

It is yet another object of my invention to provide a simple cost-effective two tier tray system.

SUMMARY OF THE INVENTION

In accordance with one aspect of my invention, a two tiered rack for use in drawers comprises a base tray having a longitudinal axis and a transverse axis; the base tray having a storage portion defined in part by a pair of upstanding longitudinal walls and a pair of upstanding transversely aligned walls to form a perimeter of the storage portion. The base tray also has a flange portion comprising a pair of flanges respectively extending outwardly from each of the longitudinally aligned upstanding walls; and a pair of longitudinally aligned tracks respectively disposed adjacent the juncture of the flanges with the upstanding walls. The rack further includes an upper tray having a longitudinal axis and a transverse axis and bearing means disposed on transversely opposed sides of the upper tray in cooperative engagement with the tracks to support the upper tray from the base tray in elevated relationship for movement thereon between a forward position in which the upper tray closes the storage portion and a rearward position in which access is provided to the storage portion.

Generally speaking, the tracks will be disposed on the flange portion, and the pair of flanges and the tracks will extend rearwardly of the storage portion, in which case the flange portion will include an apron interconnecting the rearwardly extending parts of the pair of flanges and the rearward one of the upstanding end walls.

Suitably the bearing means and the tracks will cooperate to permit the upper tray to be lifted from the base tray, to provide for its use apart from the rack, and also to permit full access to the storage portion of the base tray. Conveniently, the tracks are formed unitarily with the base tray, and they may have an upwardly open U-shaped transverse cross-section. Also conveniently the bearing means comprises a pair of longitudinally spaced apart wheels.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
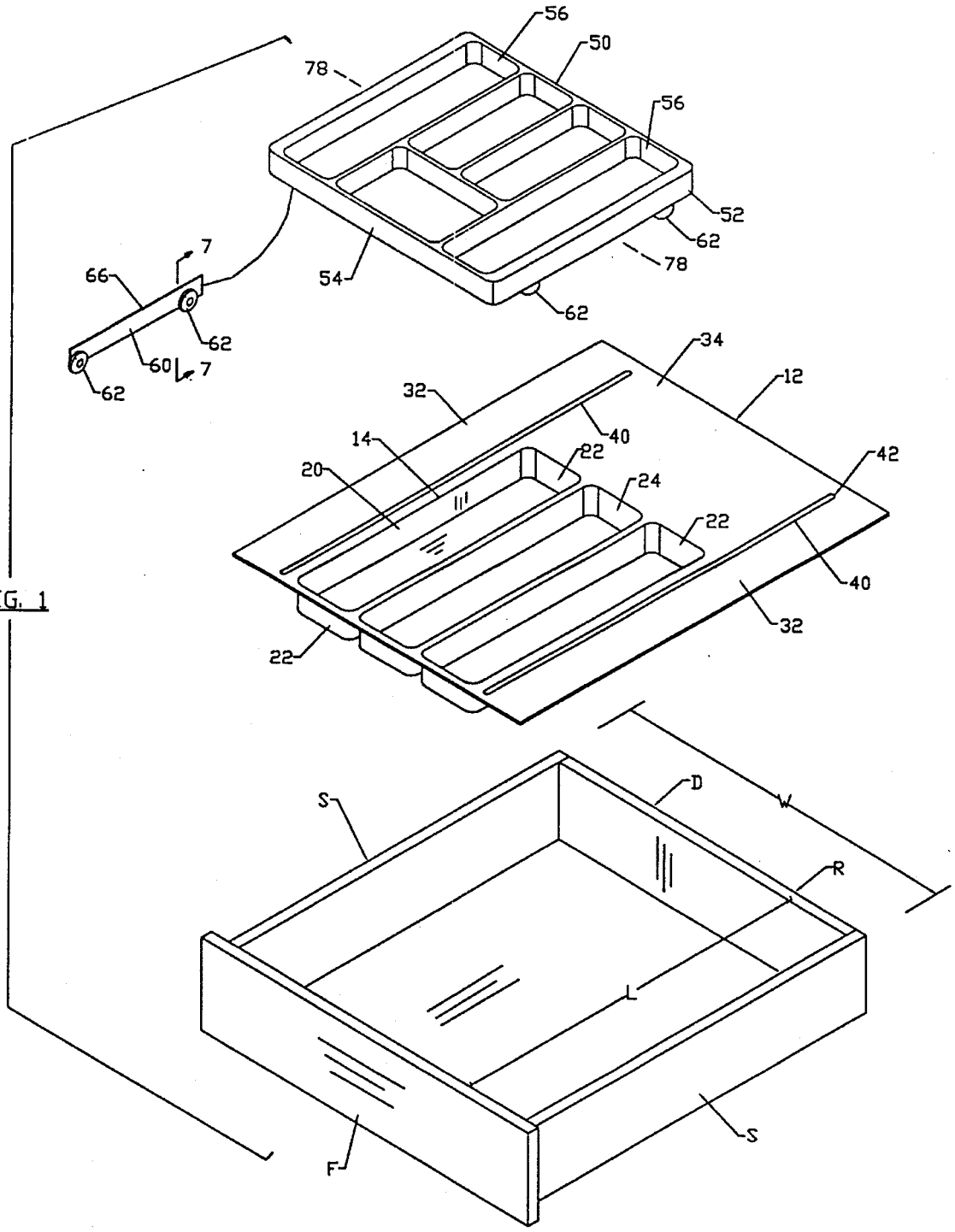
FIG. 1 shows in perspective, exploded view a two tiered tray in accordance with my invention, superimposed above a drawer.
Figure 2:
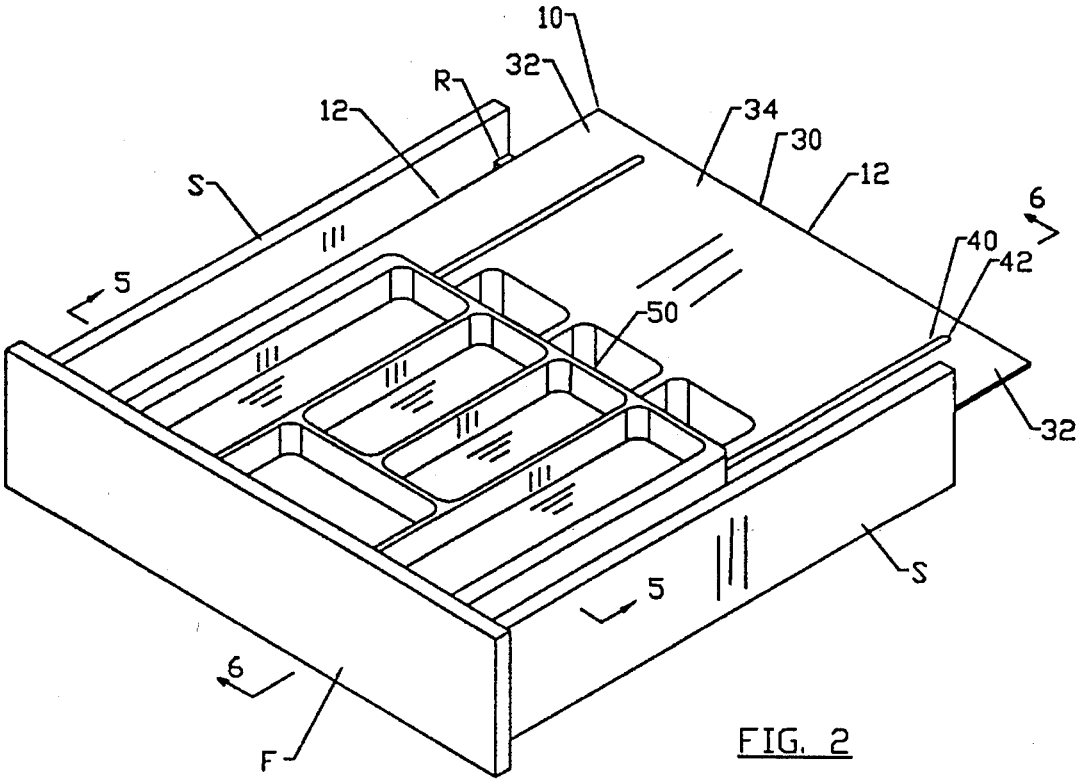
FIG. 2 shows the two tiered tray of FIG. 1 installed in a drawer, with the upper tray in its normally located forward position.
Figure 3:
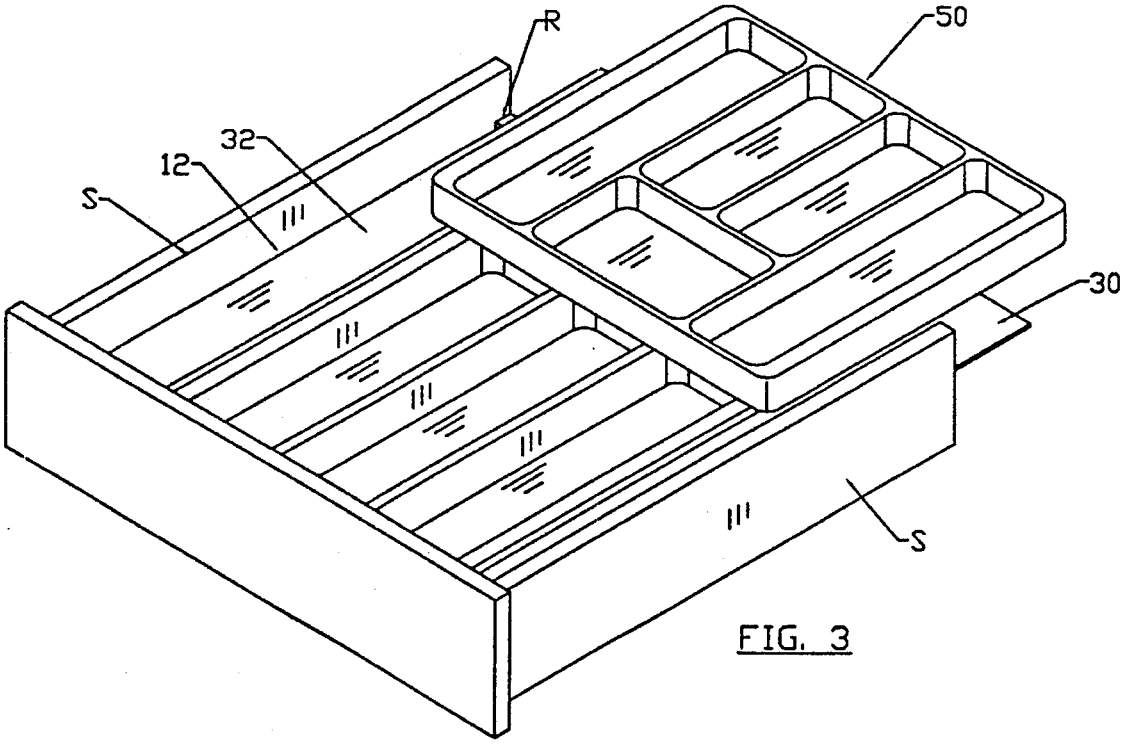
FIG. 3 is similar to FIG. 2 but shows the upper tray moved to its rearward position to provide access to the base tray.

Referring to the drawings in detail, a two tiered rack in accordance with the first embodiment of the invention as seen in FIGS. 1–3 is identified generally therein by the numeral 10. Rack 10 comprises a base tray 12 which includes a storage portion 14, which is defined in part by upstanding perimetric walls consisting of a first pair elongated in the longitudinal direction and a second pair elongated in the transverse direction, which are more conveniently referred to respectively as side walls 20 and end walls 22. Side walls 20 may be further distinguished as being left and right side walls, and end walls 22 as being front and rear end walls, the front of base tray 12 being taken as the left hand side of the sheet on which FIG. 1 is seen. Storage portion 14 is conveniently subdivided into a number of compartments 24.

Base tray 12 also includes a generally planar flange 30 which is outwardly directed from the upstanding perimetric walls 20,22, and which includes side portions 32 which extend rearwardly of rear end wall 22, and an apron portion 34 which interconnects the rearwardly extending portions of side portions 32 to each other and to rear wall 22.

Figure 5:
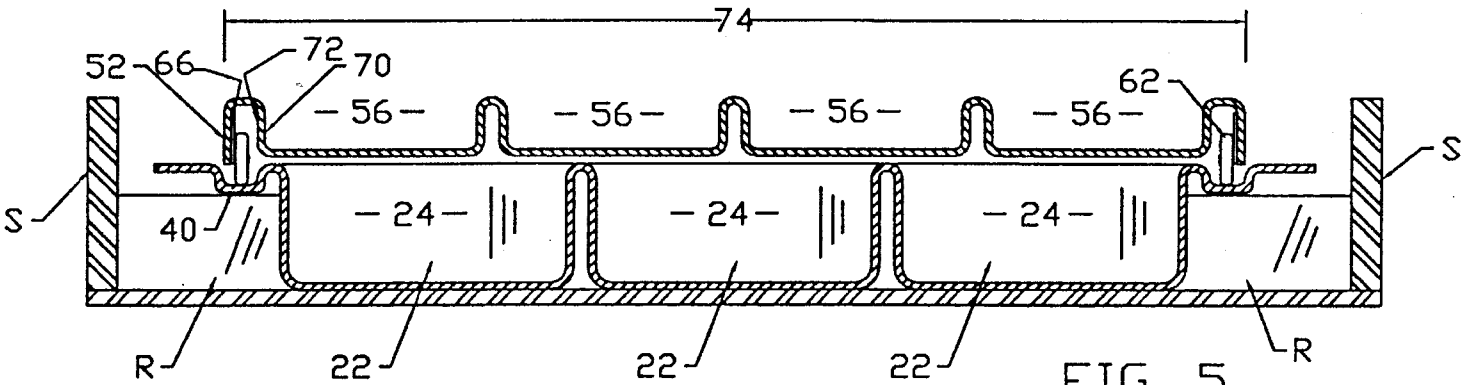
FIG. 5 is a cross section on line 5—5 of FIG. 2.

A track means is comprised of parallel left and right tracks 40 which are disposed longitudinally on flange 30 along each side portion 32 adjacent the juncture thereof with side walls 20, the tracks extending to proximate the rearward extremity of the base trays 12, at which position a stop 42 is provided. Each of tracks 40 has a generally U shaped, upwardly open cross-section as best seen in FIG. 5.

Rack 10 further comprises an upper tray 50 which is defined in part by a pair of side walls 52 interconnected by end walls 54. Tray 50 is conveniently provided with a number of storage compartments 56 therein. Bearing means 60 comprising a pair of wheels 62 is disposed on each of side walls 52. Conveniently bearing means 60 is formed as sub-assembly comprising a rectangular plate 66 to which axles 68 for the wheels 62 are secured in longitudinally spaced apart relationship, and the sub-assembly is secured to side walls 52 by any convenient means. Suitably, upper tray 50 is unitarily formed, for example by vacuum moulding technique from sheet plastic material, and side walls 52 are outwardly spaced from interior walls 70 which serve to define compartments 56, thereby providing an inverted channel 72 within which the bearing means 60 is secured so as to be hidden from view from the user. Also suitably, base tray 12 is unitarily formed together with tracks 40, for example by vacuum moulding technique from sheet plastic material.

Figure 6:
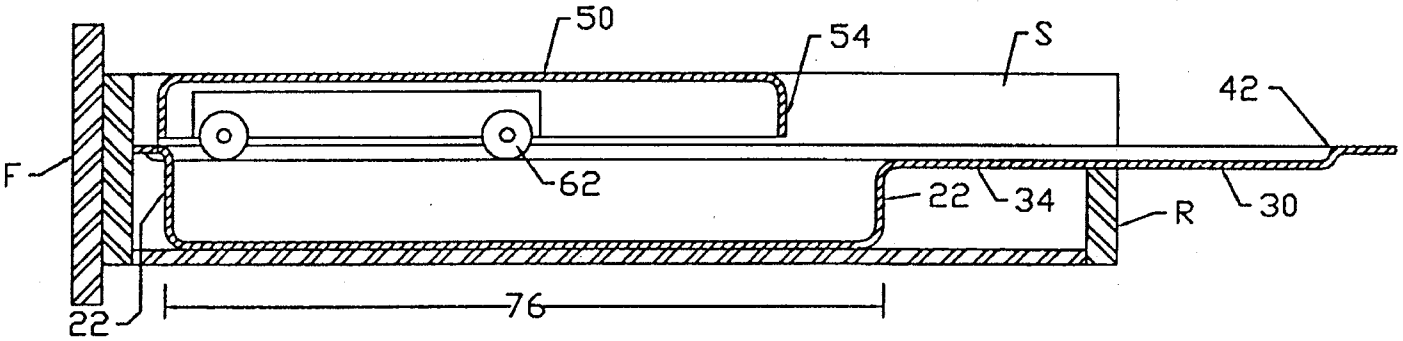
FIG. 6 is a cross section on line 6—6 of FIG. 1.

Rack 10 is intended to be used in a kitchen drawer D having opposed sides S, interconnected by a front end wall F and a rear end wall R. Generally speaking, drawer D will be installed in a cabinet having an industry standard depth of about 24 inches. There is no standard drawer length or drawer width. Rack 10 is intended to fit, or be easily adapted to fit into different drawers D having a range of lengths and of widths. Different widths of drawers D are accommodated by trimming side flange portions 32, along their length and generally speaking the maximum width of the base tray 12 will not exceed the maximum width of the drawer for which the rack 10 is recommended, so as to avoid the necessity of trimming by the installer. Also generally speaking, the maximum length of base tray 12 will not exceed about 24 inches, so as to fit within a standard cabinet. The minimum width W of drawer D that can be fitted by rack 10 will have a dimension which is somewhat greater than the overall transverse dimension 74 between left and right tracks 40, between left and right side walls 20 of the base tray 12, or between left and right side walls 52 of the upper tray 50, which ever is the greater. Similarly, the minimum length L of drawer D to which the base tray 12 can be fitted will have a dimension which is not less than the longitudinal dimension 76 between end walls 22. Where the overall length of base tray 12 exceeds the actual internal length L of drawer D, the installation procedure will depend on the relative lengths of the upper tray 50 and the storage portion 14 of the base tray 12. In accordance with the first embodiment so far described, the length of the upper tray 50 may be typically about 15.5 inches, whereas that of the storage portion of the base tray may be typically about 18 inches, generally this being the minimum length L of a drawer D. Accordingly, when the upper tray 50 is moved within the draw D to the extent of its rearward travel permitted by wall R, an opening into the storage portion of the base tray of approximately 2.5 inches will result, which is inadequate. Accordingly, under such circumstance the rear wall R of the drawer D is reduced in height by a simple carpentry operation, so as to permit the flange 30 including tracks 40 to project rearwardly beyond the rear wall R, as seen in FIG. 6, thereby increasing the permitted travel of upper tray 50 to its rearward position. The length of travel is maximized by the proper location of wheels 62 on upper tray 50. As best seen in FIG. 3, the rearward of each pair of wheels 62 is disposed somewhat forwardly of the rearward end wall 54, so that upper tray 50 may be cantilevered outwardly of the rearward edge of flange 30 when drawer D is opened, thereby providing full access to storage portion 14. Suitably the rearward of each pair of wheels 62 is disposed rearwardly of the transverse centre line 78 of upper tray 50, so as to reduce the likelihood of the upper tray tipping rearwardly. It will be appreciated that the rear wall R of drawer D will serve as a bearing wall for flange 30 and that it will as a consequence reduce the likelihood of rack 10 as a whole tipping rearwardly when the upper tray 50 is moved to its rearward position.

Figure 4:
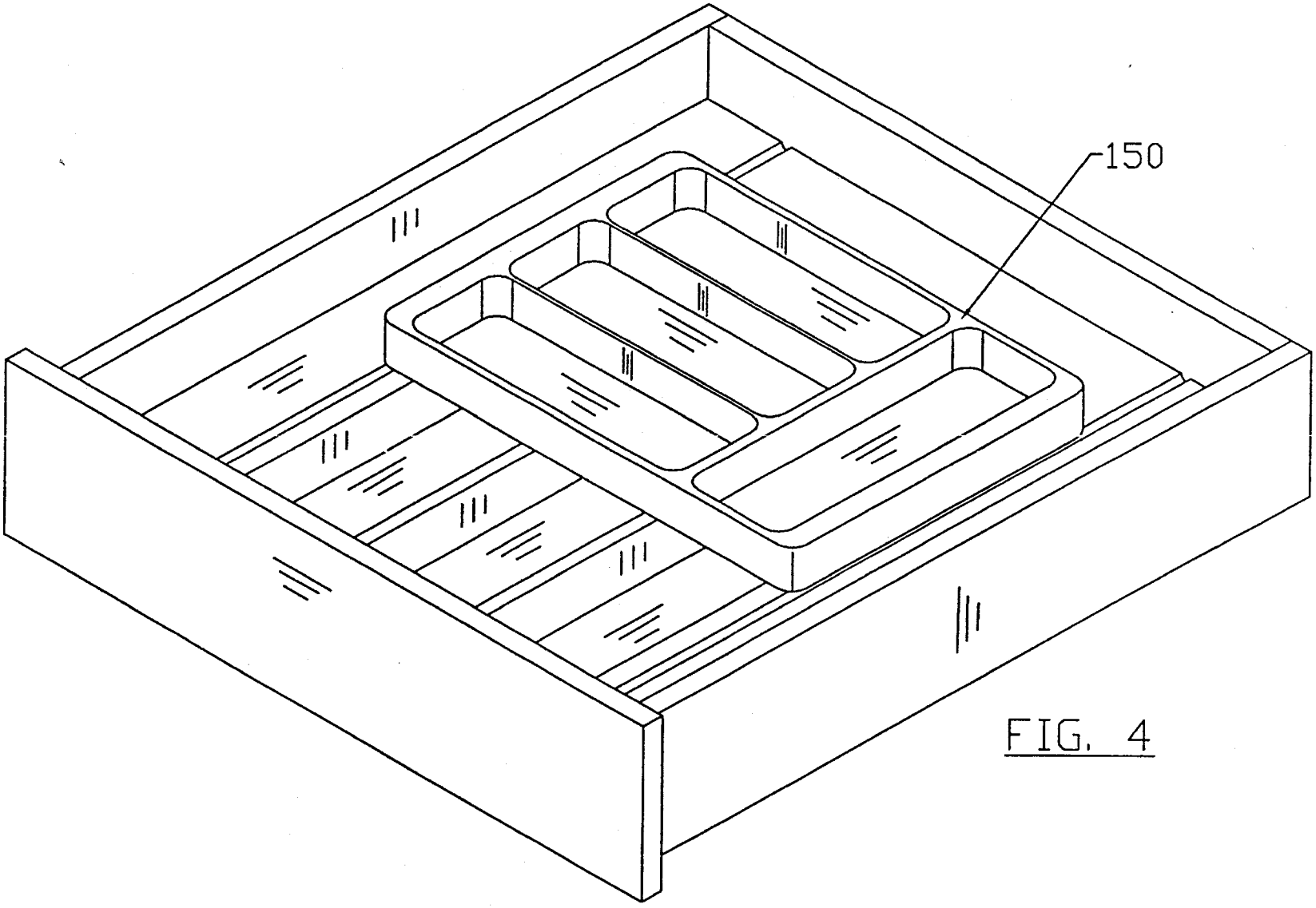
FIG. 4 is similar to FIG. 3, but shows a second embodiment of my invention.
Figure 7:
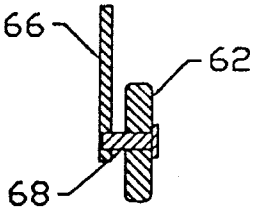
FIG. 7 is a cross-section on line 7—7 of FIG. 1.

In accordance with the second embodiment, seen in FIG. 4, the front to back length of an upper tray 150 is substantially less than in the first embodiment. Accordingly, when tray 150 is moved to its rearward position entirely within the confines of drawer D, an adequate although not full access will be provided to the storage portion 14 of the base tray 12.

It will be appreciated that in either embodiment the upper tray 50 or 150 may be disengaged from the base tray 12 simply by being lifted upwardly, so as to provide full and easy access to storage portion 14 of the base tray at all times without necessitating removal of the drawer D and/or the rack 10 as a whole.

It will be apparent that many changes may be made to the illustrative embodiments while falling within the scope of the invention, and it is intended that all such changes be covered by the claims appended hereto.

I claim:

1. A two tiered rack for use in drawers, comprising:

a base tray having a longitudinal axis and a transverse axis; said base tray having a storage portion defined in part by a pair of upstanding longitudinal walls and a pair of upstanding transversely aligned walls to form a perimeter of said storage portion;

said base tray also having a flange portion comprising a pair of flanges respectively extending outwardly from each of said longitudinally aligned upstanding walls;

a pair of longitudinally aligned, upwardly facing tracks respectively disposed on said base tray adjacent the juncture of said pair of flanges with respective said upstanding walls;

an upper tray having a longitudinal axis and a transverse axis;

bearing means disposed on transversely opposed sides of said upper tray in cooperative engagement with said tracks to support said upper tray above said base tray for movement thereon between a forward position in which said upper tray closes said storage portion and a rearward position in which access is provided to said storage portion;

wherein said tracks are formed on said pair of flanges.

2. A two tiered rack as defined in claim 1, wherein said pair of flanges and said tracks extend rearwardly of said storage portion and are interconnected together and with one of said pair of transversely aligned upstanding walls defining the rear of said storage portion by an apron forming a part of said flange portion.

3. A two tiered rack as defined in claim 1, wherein said bearing means and said tracks permit said upper tray to be lifted from said base tray.

4. A two tiered rack for use in drawers, comprising:

a base tray having a longitudinal axis and a transverse axis; said base tray having a storage portion defined in part by a pair of upstanding longitudinal walls and a pair of upstanding transversely aligned walls to form a perimeter of said storage portion;

said base tray also having a flange portion comprising a pair of flanges respectively extending outwardly from each of said longitudinally aligned upstanding walls;

a pair of longitudinally aligned, upwardly facing tracks respectively disposed on said base tray adjacent the juncture of said pair of flanges with respective said upstanding walls;

an upper tray having a longitudinal axis and a transverse axis;

bearing means disposed on transversely opposed sides of said upper tray in cooperative engagement with said tracks to support said upper tray above said base tray for movement thereon between a forward position in which said upper tray closes said storage portion and a rearward position in which access is provided to said storage portion;

wherein said bearing means has a forward portion and a rearward portion longitudinally spaced apart by a distance which is substantially less than the length of said tracks; and wherein said rearward portion is disposed on said upper tray rearwardly of the transverse centre line thereof, and said forward portion is disposed adjacent the forward end of said upper tray.

5. A two tiered rack as defined in claim 4, wherein said bearing means comprises a pair of wheels disposed on each of said transversely opposed sides of said upper tray.

6. A two tiered rack as defined in claim 4, wherein said tracks are provided with stop means adjacent the rearward end thereof.

7. A two tiered rack as defined in claim 1, wherein said tracks are unitarily formed with said base tray.

8. A two tiered rack for use in drawers having a predetermined range of longitudinal and transverse dimensions; said rack comprising:

a base tray having a longitudinal axis and a transverse axis;

said base tray including a dished storage portion defined in party by a perimetric wall including longitudinally aligned sides interconnected by transversely aligned ends, and a flange portion extending outwardly form the upper edge of said perimetric wall along each of said longitudinal sides and at least the rearward one of said ends;

track means comprising left and right longitudinally aligned upwardly facing tracks formed on said flange portion adjacent the juncture thereof with said longitudinal sides to extend rearwardly of said rearward one of said ends;

an upper storage tray having longitudinal sides and transverse ends; bearing means disposed on each of said longitudinal sides of said upper storage tray for cooperative engagement with said track means to support said upper tray above said base tray and permit said upper storage tray to be moved on said base tray between a forward position in which the forward end of said upper tray is generally aligned with the forward end of said base tray and a rearward position in which access is provided to said storage portion of said base tray;

the transverse dimension of said ends and between said left and right tracks, and the longitudinal dimension of said sides respectively exceeding the minimum transverse dimension and the minimum longitudinal dimension of a drawer having longitudinal and transverse dimensions within such predetermined range.

9. A two tiered rack as defined in claim 8, wherein said base tray has a longitudinal dimension which exceeds the maximum longitudinal dimension of a drawer having longitudinal and transverse dimensions within such predetermined range.

10. A two tiered rack as defined in claim 9, wherein said track means is provided with stop means adjacent the rearward end thereof.

11. A two tiered rack as defined in claim 9, wherein said bearing means has a forward portion and a rearward portion longitudinally spaced apart therefrom by a dimension which is substantially less than the longitudinal dimension of said track means.

12. A two tiered rack as defined in claim 8, wherein said bearing means has a forward portion and a rearward portion and said rearward portion is disposed on said upper tray intermediate the rearward end and the transverse centre line thereof.

13. A two tiered rack as defined in claim 8, wherein said bearing means has a forward portion and a rearward portion respectively disposed adjacent the forward end and the rearward end of said upper tray.

14. A two tiered rack as defined in claim 8, wherein said bearing means comprises a pair of wheels which engages with each said track.

15. A two tiered rack as defined in claim 14, wherein said upper tray has a centrally disposed downwardly dished storage portion defined in part by perimetric side walls spaced apart from said longitudinal sides to form therewith inverted U shaped channels in which said wheels are disposed.

16. A two tiered rack as defined in claim 8, wherein said track means is unitarily formed with said base tray.

17. A two tiered rack as defined in claim 16, wherein said tracks are U shaped in transverse cross section.

18. A two tiered rack as defined in claim 7, wherein said tracks and said bearing means are engageable together in the vertical direction.

19. A two tiered rack as defined in claim 3, wherein said tracks have a U shaped cross section and are upwardly open.

* * * * *